US005408948A

United States Patent [19]

Arii et al.

[11] Patent Number: 5,408,948

[45] Date of Patent: Apr. 25, 1995

[54] TWIN-HULL BOAT WITH HYDROFOILS AND CONTROL SYSTEM

[75] Inventors: Toshihiko Arii, Ibaraki; Isamu Takenaka, Osaka; Katsuaki Fujiya, Takarazuka; Tadao Takai, Ikoma; Yuki Nakagawa, Itami; Yasuo Nakai, Katano, all of Japan

[73] Assignee: Hitachi Zosen Corporation, Osaka, Japan

[21] Appl. No.: 218,226

[22] Filed: Mar. 25, 1994

[30] Foreign Application Priority Data

Mar. 31, 1993 [JP] Japan ..... 5-072623
Mar. 31, 1993 [JP] Japan ..... 5-072624

[51] Int. Cl.[6] ..... B63B 1/24
[52] U.S. Cl. ..... 114/274; 114/61
[58] Field of Search ..... 114/274–277, 114/144 E; 318/584–588; 364/457, 434

[56] References Cited

U.S. PATENT DOCUMENTS 2,696,796 12/1954 Amster ..... 114/277
3,156,209 11/1964 Ask ..... 114/275
3,886,884 6/1975 Stark et al. ..... 114/275
5,152,239 10/1992 Hossfield et al. ..... 114/144 E

*Primary Examiner*—Edwin L. Swinehart
*Attorney, Agent, or Firm*—Barnes, Kisselle, Raisch, Choate, Whittemore & Hulbert

[57] ABSTRACT

A novel twin hull boat equipped with a pair of hydrofoils (3) and (4) comprising; a plurality of independently driven auxiliary wings (5/5) and (6/6) respectively being secured to both ends of a front hydrofoil (3) and a rear hydrofoil (4) secured to the bottom of the hull (1); a height sensor (11) for measuring height of the stem form water surface; a pair of inertia sensors or gyroscopes (13A) and (13B) for detecting rolling and pitching angles of the hull (1); a wing-angle sensor (10) for detecting angles of the auxiliary wings (5/5) and (6/6); and a controller (14) for controlling height of the stem constant, preventing the front hydrofoil (3) from coming out of water surface, and also controlling rolling and pitching behaviors of the hull (1) by driving the auxiliary wings (5/5) and (6/6) in accordance with a specific control mode selected by control-mode-setting switches (21) and (22).

5 Claims, 8 Drawing Sheets

TWIN-HULL BOAT WITH HYDROFOILS AND CONTROL SYSTEM

FIELD OF THE INVENTION

The present invention relates to a twin-hull boat which is equipped with a plurality of hydrofoils and capable of cruising itself afloat at a high speed.

BACKGROUND OF THE INVENTION

Today, any of conventional surface-piercing type hydrofoil boats is equipped with a plurality of hydrofoils submergibly extended below the stem and the stern so that the boat can cruise itself at a high speed by way of decreasing hull resistance via proper function of hydrofoils for sustaining the hull lifted out of the water.

Nevertheless, according to the concept of such conventional surface-piercing type hydrofoil boat, since part of hydrofoils is extended above the water surface and constantly hit by waves while the boat cruises itself, so-called sea-worthiness remains poor, and in addition, since the hull itself cannot properly be stabilized against rolling effect generated by beam waves, cruising comfort cannot fully be provided.

DISCLOSURE OF THE INVENTION

Therefore, a primary object of the invention is to provide a novel twin-hull boat equipped with a plurality of hydrofoils, which is capable of sustaining satisfactory sea-worthiness and providing improved cruising comfort.

To achieve the object, the novel twin-hull boat according to the invention is equipped with a plurality of hydrofoils below the bottom plate corresponding to the stem and the stern of the hull.

Structurally, a plurality of independently driven auxiliary wings are provided at both-end domains of each hydrofoil. A height position sensor is provided on the top surface of the stem in order to correctly measure height position of the stem against water surface. In addition, a pair of inertia sensors or gyroscopes provided on the center of ship motion of the hull 1 detect rolling angle of the hull 1. A controller system is provided in order to properly control operation of the auxiliary wings based on stem-height-detect signals delivered from the stem height position sensor and rolling-angle-detect signals from the inertia sensors or the gyroscopes so that the height position of the stem against water surface and anti-rolling behavior of the twin-hull boat can be sustained constant.

According to the structure embodied by the invention, based on the stem-height-detect signals from the stem height position sensor and the rolling-angle-detect signals from the inertia sensor or the gyroscope, auxiliary wings provided for hydrofoils are operated in order to properly control height of the stem at a constant position. In consequence, the novel twin-hull boat can cruise itself without causing the twin-hull to come out of the water surface while the hydrofoils remain in submerged state. At the same time, rolling behavior of the twin hull is minimized to result in the stable cruising posture. Therefore, the hydrofoil in the front position is free from attack of waves, thus effectively preventing the front hydrofoil from incurring excessive impact load of waves. In consequence, the novel twin-hull hydrofoil boat can constantly cruise itself under stable condition by way of minimizing rolling effect caused by beam waves, thus securely promoting cruising comfort.

DESCRIPTION OF THE PREFERRED EMBODIMENTS

Figure 1:
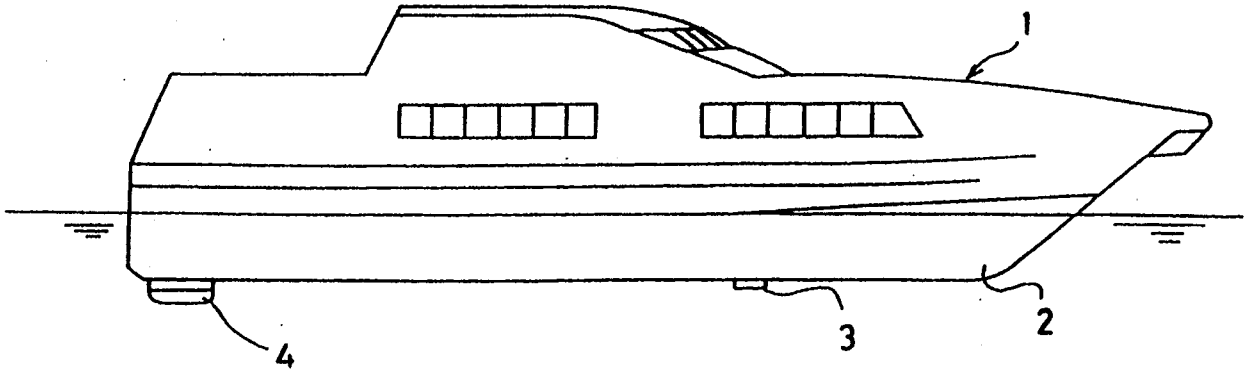
FIG. 1 is a lateral view of the novel twin-hull boat equipped with a plurality of hydrofoils according to an embodiment of the invention.
Figure 2:
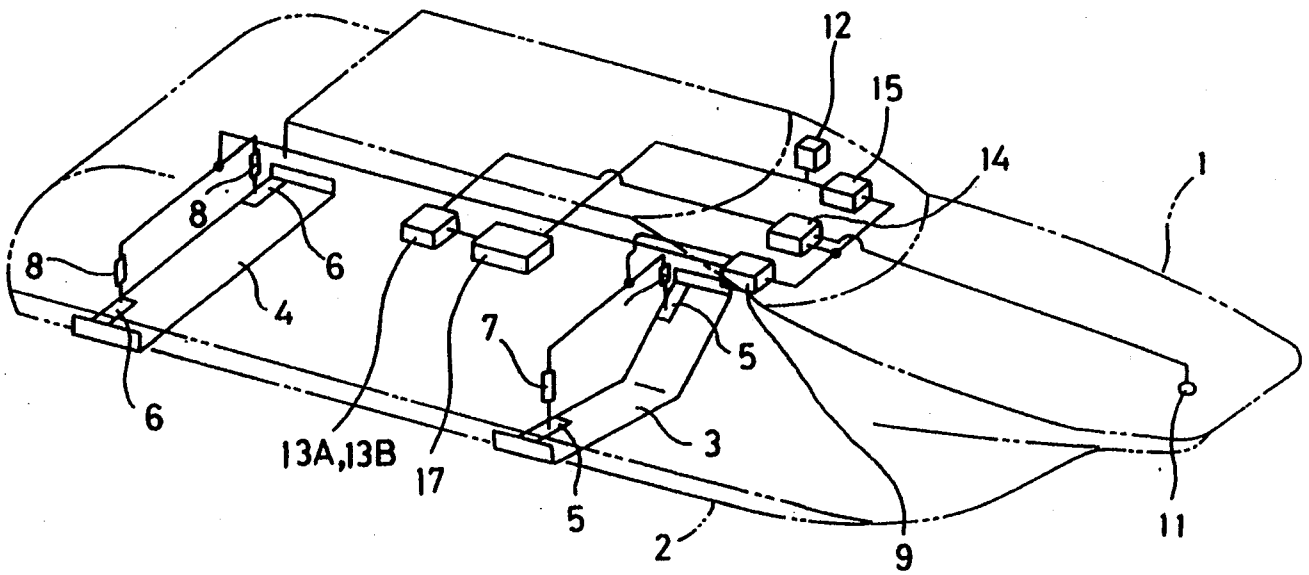
FIG. 2 is a schematic diagram of a controller system provided for the novel twin-hull boat with a plurality of hydrofoils.

The invention provides a novel water-jetting twin-hull boat equipped with a plurality of hydrofoils. As shown in FIG. 1, a pair of leg members 2 and 2 extended in the fore-and-aft direction are projectively secured to the bottom plate of the hull 1. A front hydrofoil 3 and a rear hydrofoil a are submergibly secured to the bottom plate of the hull 1 between the leg members 2 and 2. In addition, as shown in FIG. 2, a pair of auxiliary wings 5 and 5 and another pair of auxiliary wings 6 and 6 are respectively secured to both sides of the bottom of the stem portion and both sides of the bottom of the stern portion, which are respectively driven independent of each other. As means for driving the auxiliary wings 5/5 and 6/6, a pair of wing-control oil-pressure cylinders 7 and 8 are respectively secured to the bottom region of the leg members 2 and 2. By virtue of oepration of the oil-pressure cylinders 7 and 8, those auxiliary wings 5/5 and 6/6 vertically slide themselves by way of pivoting on corresponding rotary shafts (not shown). The oil pressure cylinders 7 and 8 are respectively driven by means of servo amplifiers 9 shown in FIG. 3. The oil-pressure cylinders 7 and 8 respectively incorporate a stroke sensor (wing-angle sensor) 10 for identifying actual angles of the auxiliary wings 5/5 and 6/6.

A stem height position sensor 11 for measuring actual height between th stem and water surface is secured to the stem of the hull 1. The stem height position sensor 11 is based on ultrasonic system, which initially computes actual height of the stem against water surface by way of emitting signals containing scores of KHz-order frequency onto water surface and then counts time spent until receiving wave forms reflected by water surface. Since wave forms reflected from water surface is not always receivable because of fluctuating posture of the hull 1, the stem height position sensor 11 incorporates such a function to store the stem height positional data.

A global positioning system (GPB) 12 substantially being free from external disturbance is provided on the top of the hull 1 in order to identify actual positional (azimuthal) data of the cruising boat 1. The GPB 12 is functionally a radio navigation assisting system utilizing a plurality of satellites travelling along orbital paths at high altitudes in space, which correctly identifies actual position of the cruising boat 1 based on distance and speed of variation of distance.

In addition, a first inertia sensor (or a gyroscope) 13A and a second inertia sensor (or a gyroscope) 13B are also provided. The former sensor 13A identifies actual rolling angle and speed of variation of rolling angle present in the hull 1 based on motion of the hull 1, whereas the latter sensor 13B identifies actual pitching angle based on motion thereof. It should be understood however that, since error may be generated by acceleration while the boat is on the way of making a turn at a high speed, the inertia sensors 13A and 13B may respectively need to correct error of acceleration by way of extracting data related to speed and bearing of the boat from signals generated by the global positioning system (GPE) 12.

Figure 3:
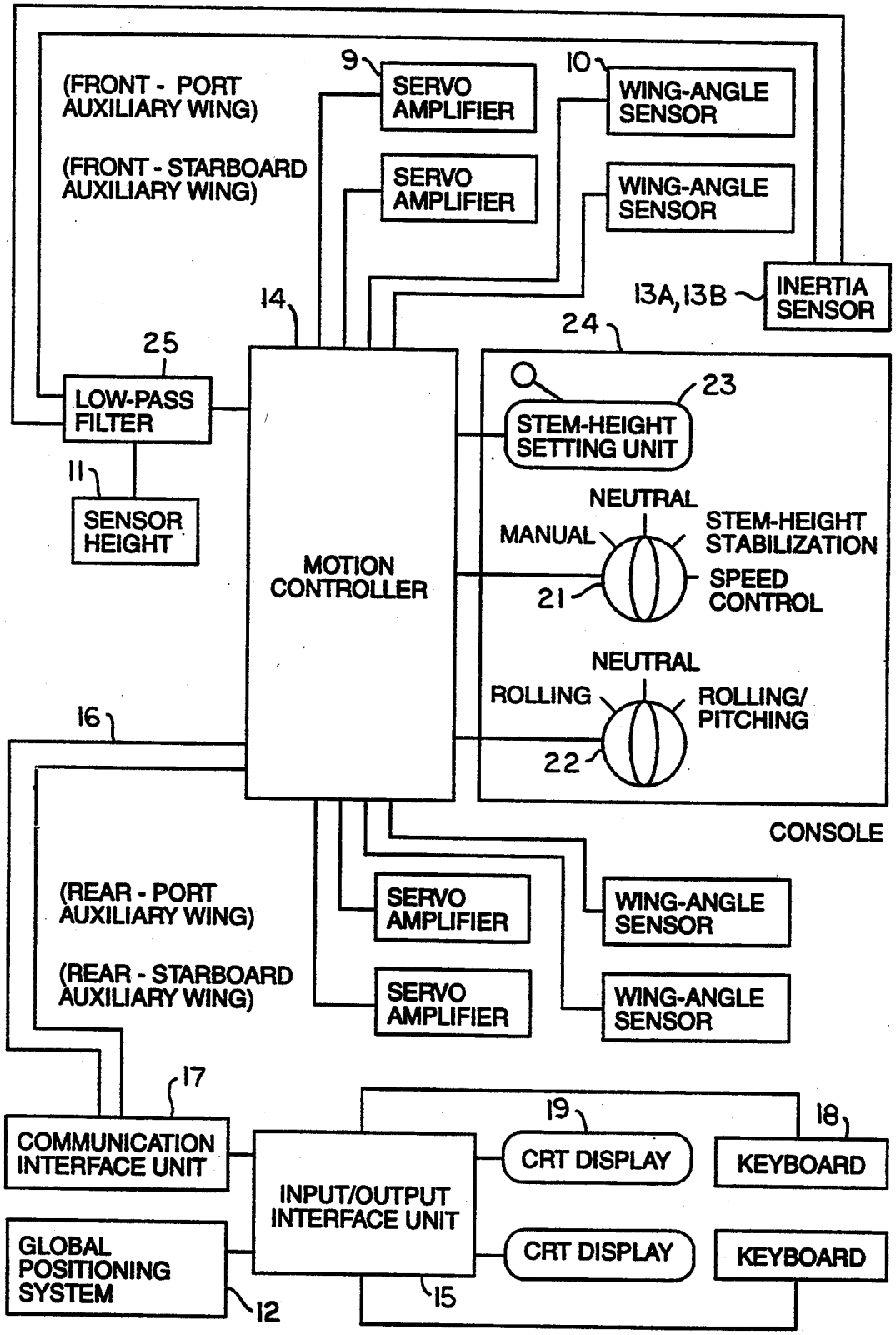
FIG. 3 is a detailed schematic block diagram of the controller system provided for the novel twin-hull boat shown in FIG. 1.
Figure 4:
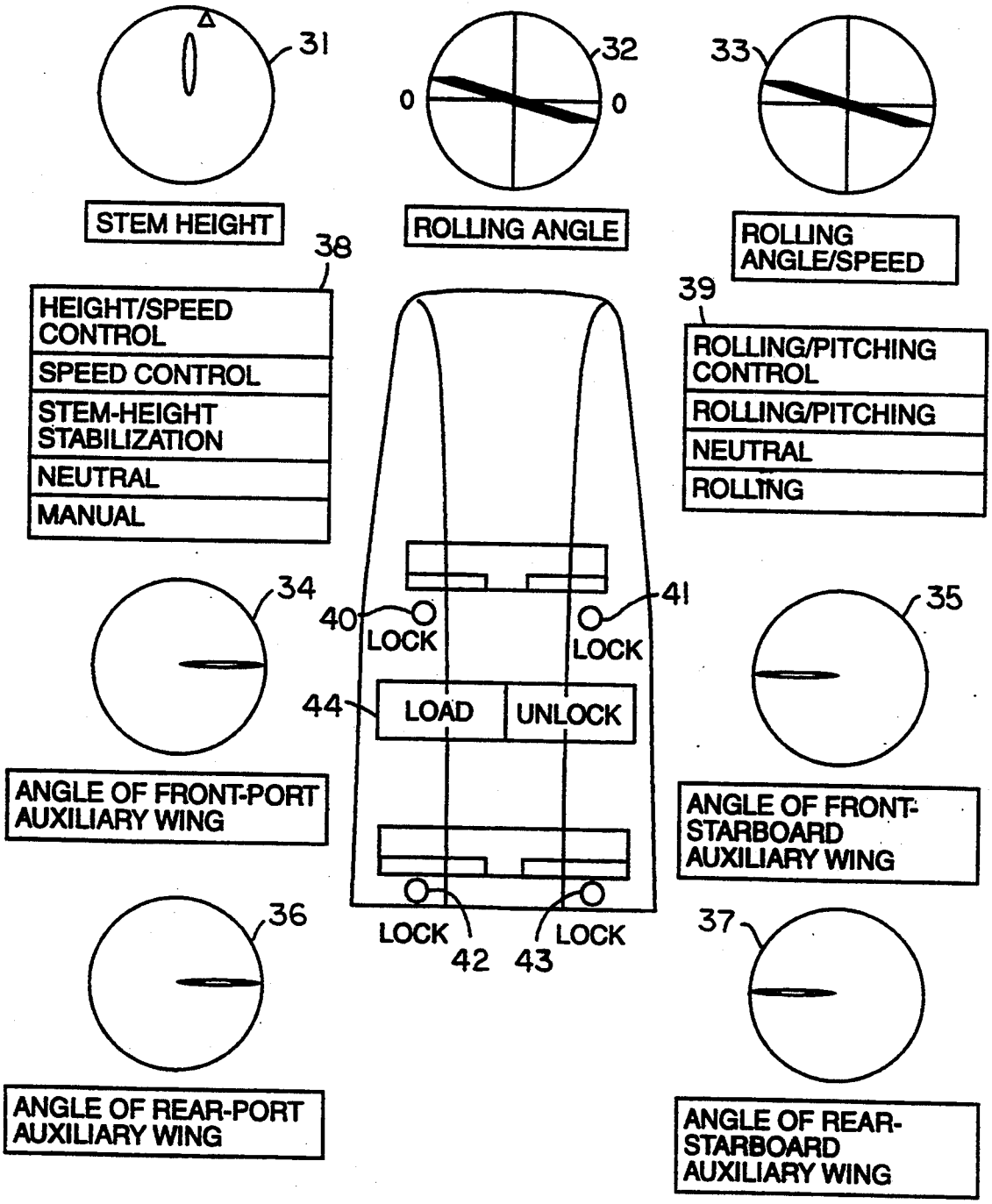
FIG. 4 is a schematic diagram of display images of an input/output interface unit provided for the twin-hull boat shown in FIG. 1.

The hull 1 is provided with an input/output interface unit 15 which measures data on a main engine and an auxiliary engine, generates alarm, controls a generator, measures motion control data, inputs parameter, and communicates data with an motion control unit 14 to be described later on. The input/output interface unit 15 incorporates a variety of motion control functions including graphic display, data trend, input of parameter, and data communication. Since the motion control unit 17 is devoid of display unit, parameter input unit, and data accumulation unit, as shown in FIG. 3, a pair of circuits 16 and 16 are provided between the motion control unit 14 and the input/output interface unit 15. A communication input/output unit 17 is provided for the circuits 16. By operating a keyboard 18 provided for the input/output interface unit 15, data needed for controlling control-gain parameter and digital filter cut-off frequency are output from the input/output interface unit 15 to the motion control unit 12 via the first circuit 15. On the other hand, data related to hull posture such as height of the stem from water surface, rolling angle, speed of variation of rolling angle, actual angle of the auxiliary wings 5/5 and 6/6, and actual control mode, are output from the motion control unit 12 to the input-/output interface unit 15 via the second circuit 16. A cathode ray tube (CRT) 19 connected to the input/output interface unit 15 displays processed data and determines trend of respective data. FIG. 2 illustrates a typical example of image data displayed on the CRT screen 19. The reference numerals 31 through 37 respectively designate content of display corresponding to meters. The reference numerals 38 through 44 respectively designate content of display corresponding to display lamps. Positional data of the hull 1 identified by the global positioning system 12 is transmitted to the input-/output interface unit 15, which then computes the actual cruising speed and the actual bearing of the hull 1, and then transmits the computed data to the motion control unit 14.

Incidentally, by way of independently driving the auxiliary wings 5/5 and 6/6, the motion control unit 12 controls height of the stem to be constant against water surface. At the same time, it also controls cruising speed of the boat hull 1 by way of preventing the submergible front hydrofoil 3 from skipping over water surface. Simultaneously, the motion control unit 14 controls rolling and pitching behaviors of the hull 1. The motion control unit 14 consists of a general-purpose board computer. As shown in FIG. 3, the motion control unit 14 is integrated with a console unit 24 incorporating a stem height/cruising speed control switch 21, a rolling-/pitching control switch 22, and a stem-height setting unit 23 for manually setting height of the stem against water surface. The stem height/cruising speed control switch 21 incorporates 4 modes of control positions including cruising-speed control position, stem-height stabilizing position, neutral position, and maual control position. The rolling/pitching control switch 22 incorporates 3 mode control positions including rolling control position, neutral position, and rolling/pitching control position. When either the former switch 21 or the latter switch 22 activates automatic control mode for controlling cruising speed, stabilizing height of the stem from water surface, and controlling rolling and pitching behavior of the hull 1, in accordance with data processing operation of the motion control unit 14, the auxiliary wings 5/5 and 6/6 are independently controlled. When the manual control mode is entered, a stem-height setting signal generated by the stem-height setting unit 23 is directly transmitted to the servo amplifiers 9 so that only the front auxiliary wings 5/5 can be operated. Control positions of those control-mode-setting switches 21 and 22 may be used by way of combining with each other. Actual control mode selected by the former switch 21 or the latter switch 22 is displayed on the CRT screen 19. When the auxiliary wings 5/5 and 6/6 are respectively locked at an angle of elevation, the state of locking is also displayed on the CRT screen 19.

After filtering out noise component from signals via a low-pass filter 25, noise-free signals from the stem-height sensor and the inertia sensors (or gyroscopes) 13A and 13B are respectively transmitted to the motion control unit 14. Simultaneously, the motion control unit 12 also receives detect signal from the wing angle sensor 10 and processed data related to the cruising speed and the actual bearing of the boat from the input/output interface unit 15. At the same time, the motion control unit 14 also receives signals for operating the switches 21 and 22 and the stem-height setting unit 23 accommodated in the console unit 24. After computing control program (to be described later on), the motion control unit 14 outputs drive signals corresponding to angle of elevation of the auxiliary wings 5/5 and 6/6 for delivery to the servo amplifiers 9 in order to operate the auxiliary wings 5/5 and 6/6 so that cruising operation of the boat 1 can properly be maintained.

Next, control operation for stabilizing height position of the stem against water surface at a constant level and controlling cruising speed as well as rolling and pitching behaviors of the hull 1 executed by the motion control unit 14 is described below.

When the stem-height/cruising-speed control switch 21 selects the stem-height stabilizing position, operation for stabilizing the height of the stem is executed by way of driving the auxiliary wings 5/5 on both sides of the front hydrofoil 3 while sustaining identical angle between both sides in order that a specific target value of the stem height predetermined via oepration of the keyboard 18 of the input/output interface unit 15 can correctly match the input height data received from the stem-height sensor 11.

When the rolling/pitching control switch 22 selects the rolling control position, data on the rolling angle of the hull 1 picked up by the inertia sensor 13A is corrected by applying data related to the cruising speed and the bearing of the hull 1 delivered from the input-/output interface 15. At the same time, operation for controlling rolling behavior of the hull 1 is executed by driving all the auxiliary wings 5/5 and 6/6 on both sides of the front and rear hydrofoils in the inverse direction from the left to the right or vice versa in order that a rolling-angle target value predetermined by the keyboard 18 of the input/output interface unit 15 can exactly match the corrected rolling angle. As a result of execution of the above operation for controlling rolling effect, unwanted rolling behavior of the hull 1 is effectively suppressed by providing the hull 1 with specific moment inverse from own rolling behavior of the hull 1.

On the other hand, when the rolling/pitching control switch 22 selects the rolling/pitching control position, data on the pitching angle of the hull 1 picked up by the second inertia sensor 13B is corrected by applying data related to the cruising speed and the bearing of the hull 1 delivered from the input/output interface unit 15. At the same time, operation for controlling pitching behavior of the hull 1 is executed by driving the front auxiliary wings 5/5 at an identiacal angle at both sides and also by driving the rear auxiliary wings 6/6 in the inverse direction by an identical angle at both sides in order that a pitching-angle target value predetermined by the keyboard 18 of the input/output interface unit 15 can exactly match the corrected pitching angle. As a result of execution of the above operation for controlling pitching effect, unwanted pitching behavior of the hull 1 is effectively suppressed by providing the hull 1 with specific moment inverse from own pitching behavior of the hull 1.

When the above switches 21 and 22 conjunctionally select the neutral control position, all the auxiliary wings 5/5 and 6/6 on both sides of the front and rear hydrofoils 3 and 4 are locked at a specific angle of elevation initially provided for these hydrofoils 3 and 4. On the other hand, when the above-referred stem-height/speed control switch 21 selects the manual control position, height-setting signal set by the stem-height setting unit 23 is directly transmitted to the servo amplifiers 9 provided for auxiliary wings 5/5 respectively being set to the left and to the right of the front bottom of the hull 1 in order that the front auxiliary wings 5 and 5 can be driven simultaneously.

FIGS. 5 through 8 schematically designate block diagrams of the motion controller 14 for controlling operations of the auxiliary wings 5/5 and 6/6 provided for the front and rear hydrofoils 3 and 4.

Figures 7A, 7B:
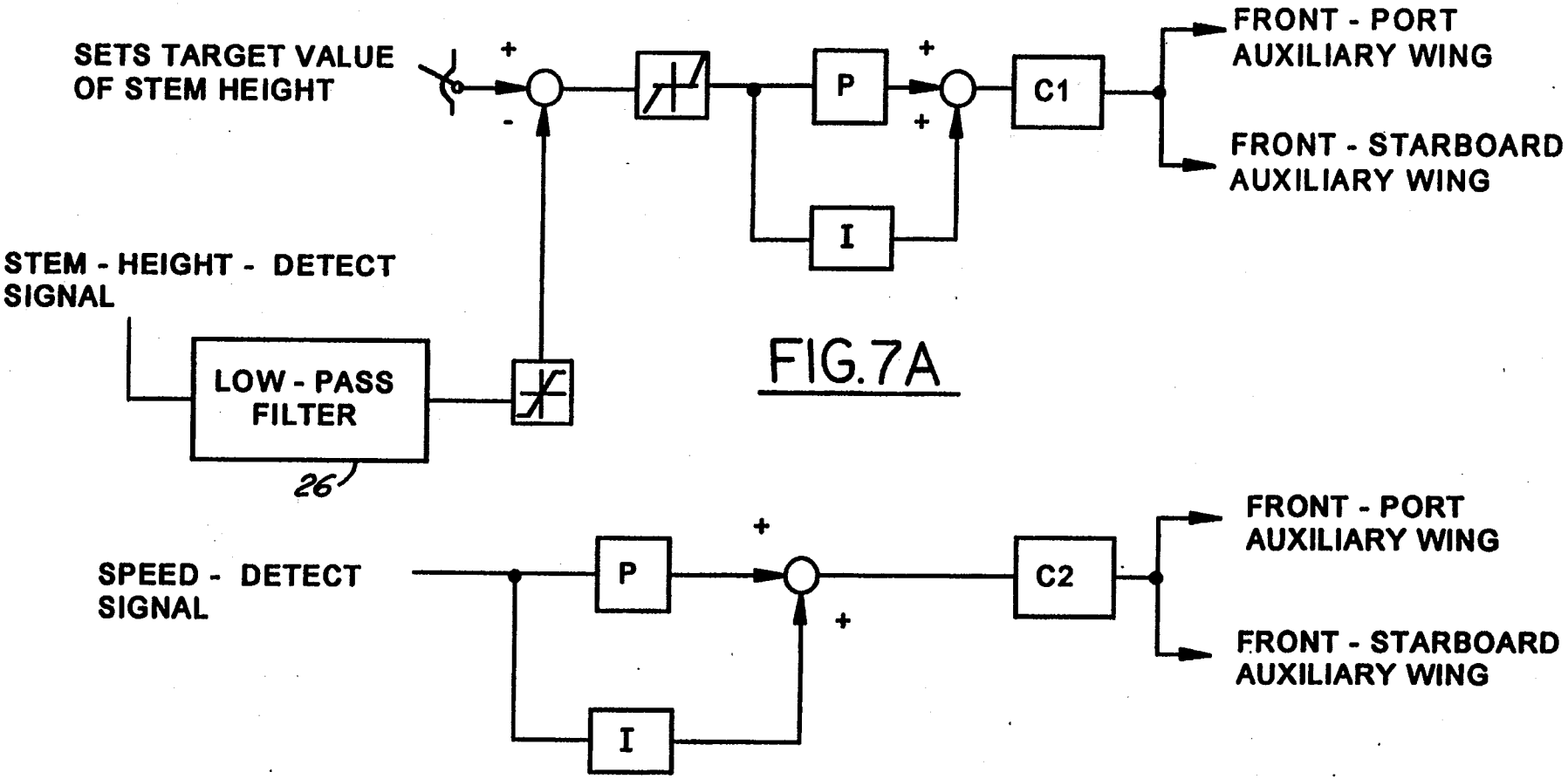
Figure 8:
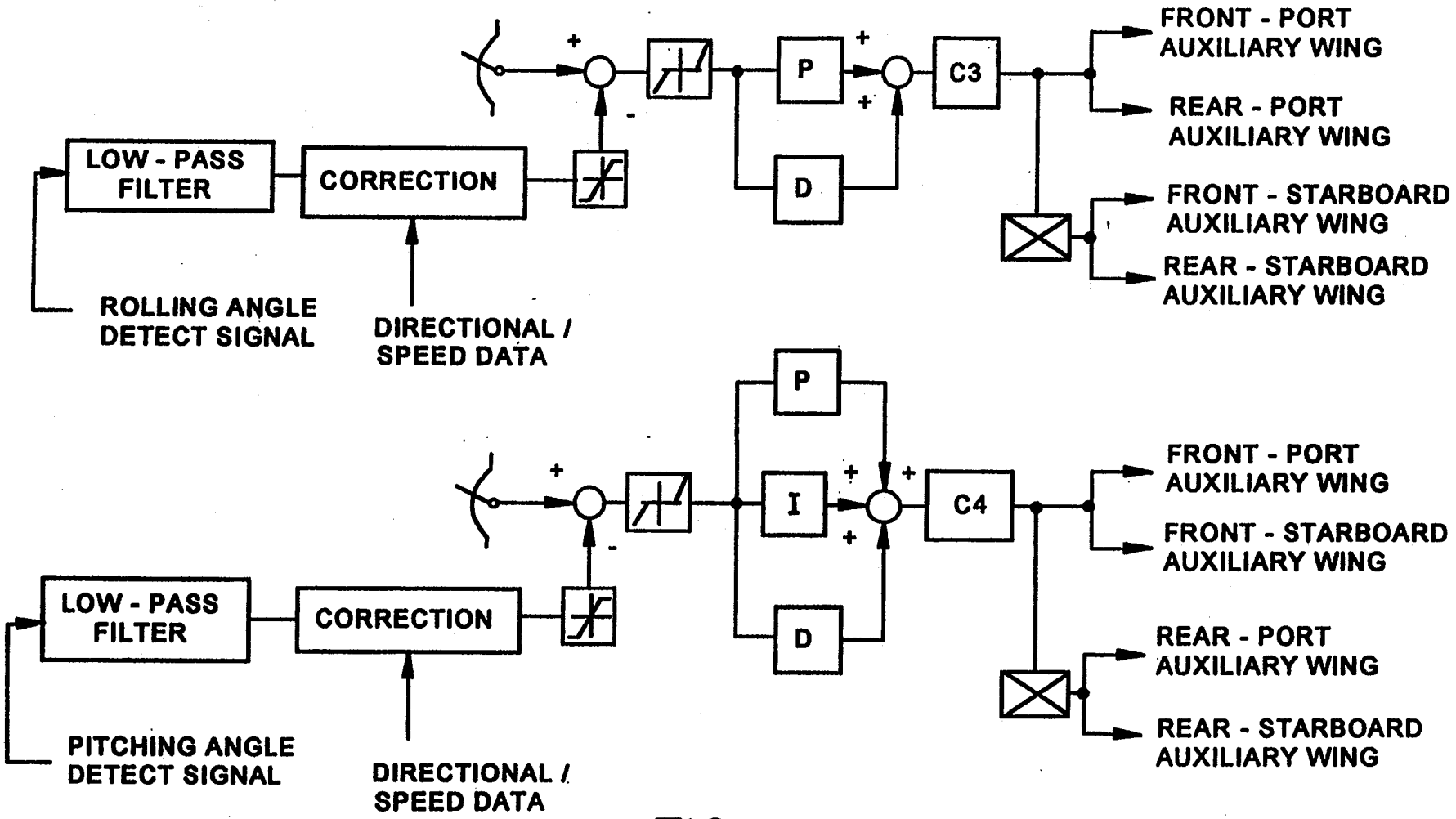

As shown in FIGS. 7 and 8, the motion controller 14 executes control programs based on PID control system. When controlling height of the stem to be constant against water surface, in order to improve stationary characteristic by way of minimizing deviation from the target value, PI control is executed. When controlling rolling behavior of the hull 1, in order to quickly restore normal posture (in terms of transitional characteristic) of the hull 1 whenever rolling takes place, PD control is executed. When controlling pitching behavior of the hull 1, in order to quickly restore normal posture (in terms of transitional characteristic) of the hull 1 whenever pitching takes place, PID control is executed. Integral component (I) is instrumental to improve the stational characteristic, whereas differential component (D) is instrumental to improve transitional characteristic. When controlling cruising speed, in order to prevent the hull 1 from floating lifting above the water surface due to accelerated cruising speed, PI control is executed by way of generating a specific value for instructing operative angle of the front auxiliary wings 5/5 corresponding to actual cruising speed. The motion controller 14 receives signals from the height sensor 11 and the inertia sensors 13A and 13B via a plurality of low-pass filters 25 and further through a digital low-pass filter 26 after fully filtering out noise component from incoming signals. Cut-off frequency can be accommodated in the digital low-pass filter 26 by operating the keyboard 18 provided for the input/output interface unit 15.

Figure 5:
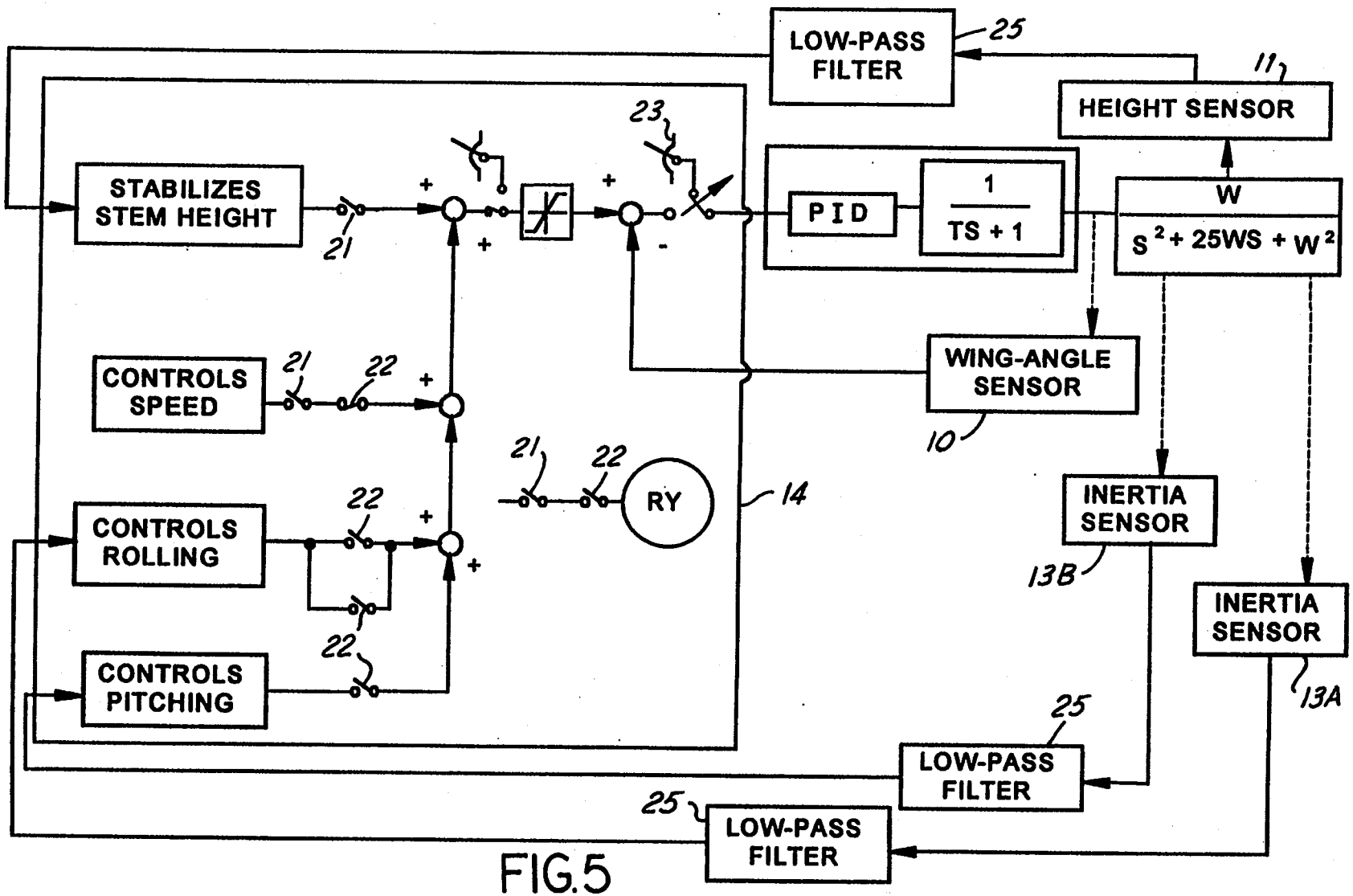
FIGS. 5 through 8 respectively designate detailed block diagrams of the controller system for controlling ship motion of the novel twin-hull boat equipped with hydrofoils according to the invention.

As shown in FIG. 5, according to control positions of the control-mode setting switches 21 and 22, either the stem-height stabilizing control mode, or speed control mode, or rolling control mode, or pitching control mode, is selected for operating the auxiliary wings 5/5 of the front hydrofoil 3. It is also possible to lock the auxiliary wings 5/5 to the neutral position (i.e., the initially set angle of elevation) or directly drive them by applying the stem-height setting signal generated by the stem-height setting unit 23.

Figure 6:
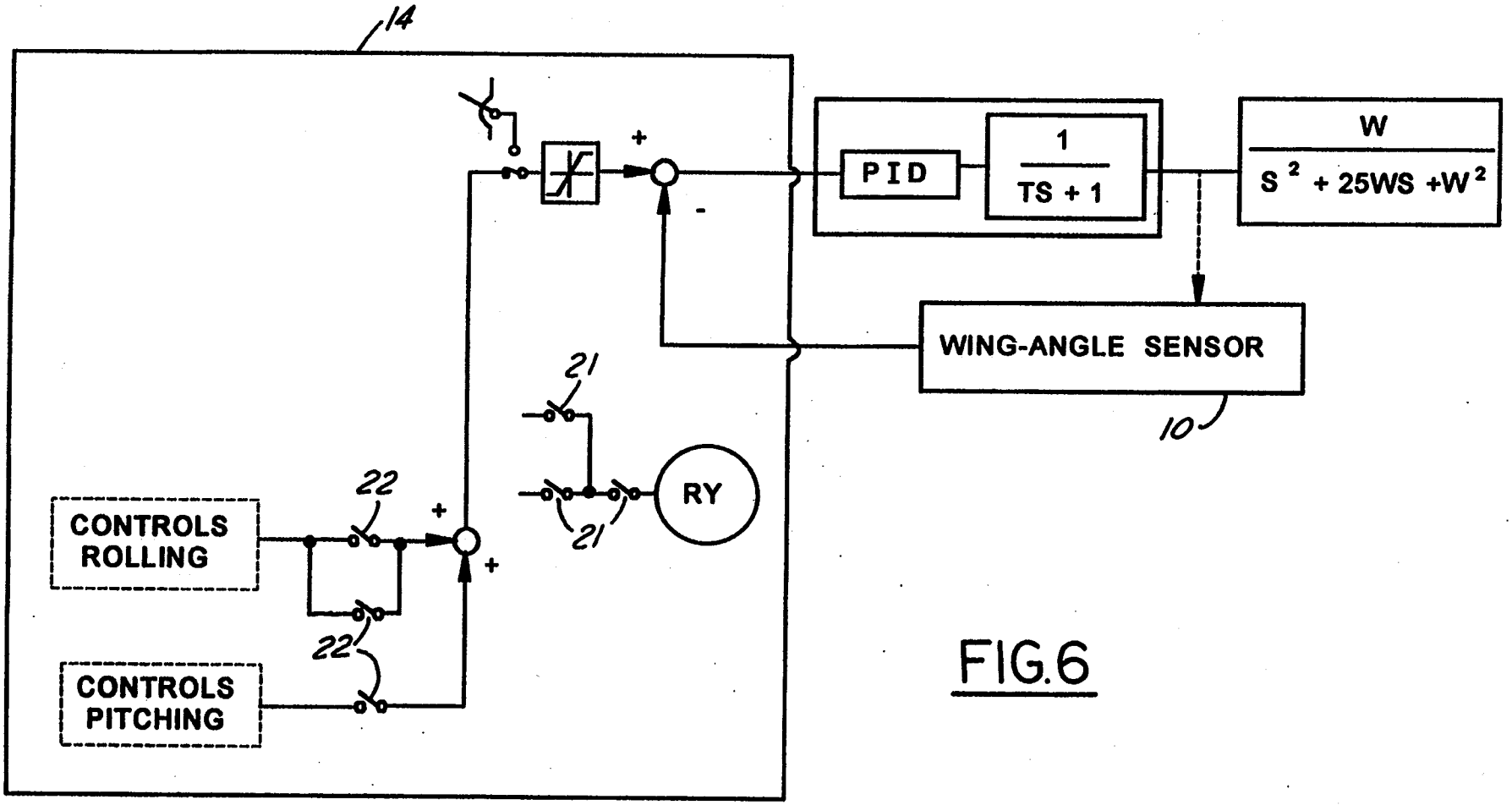

As shown in FIG. 6, according to control positions of the control-mode setting switches 21 and 22, either the rolling control mode or the pitching control mode is selected for operating the auxiliary wings 6/6 of the rear hydrofoils 4. It is also possible to lock the auxiliary wings 6/6 to the neutral position (i.e., the initially set angle of elevation).

When the control position for stabilizing height of the stem and the rolling control position are discretely selected by the stem height/speed control switch 21 and the other rolling/pitching control switch 22, the stem-height stabilizing control mode and the rolling control mode are complexly applied to the auxiliary wings 5/5 of the front hydrofoil 3, whereas the rolling control mode is applied to the auxiliary wings 6/6 of the rear hydrofoil 4. Therefore, the stem-height stabilizing control mode and the rolling control mode are simultaneously activated. According to the stem height stabilizing control mode, the auxiliary wings 5/5 on both sides of the front hydrofoil 3 are respectively driven at an identical operative angle so that the objective height value can be achieved. In consequence, posture of the hull 1 is stabilized by way of sustaining height of the stem constant, thus preventing the front hydrofoil 3 from incurring excessive impact load generated by own skipping behavior. According to the rolling control mode, in order to achieve the objective value of rolling angle, the left-side auxiliary wings 5 and 6 of the front and rear hydrofoils 3 and 4 are respectively driven at an identical operative angle, whereas the right-side auxiliary wings 5 and 6 of the front and rear hydrofoils 3 and 4 are respectively driven at an identical operative angle in the inverse direction, thus making it possible to properly control rolling angle to result in the minimized motion of the hull 1.

On the other hand, when the speed control position and the rolling control position are discretely selected by the stem-height/speed control switch 21 and the rolling/pitching control switch 22, the speed control mode and the rolling control mode are complexly applied to the auxiliary wings 5/5 of the front hydrofoil 3, whereas the rolling control mode is applied to the auxiliary wings 6/6 of the rear hydrofoil 2. Therefore, the speed control mode and the rolling control mode are simultaneously activated. According to the speed control mode, the auxiliary wings 5/5 on both sides of the front hydrofoil 3 are respectively driven at an identical operative angle in correspondence with actual cruising speed, thus preventing the front hydrofoil 3 from incurring excessive impact load generated by own skipping behavior. According to the rolling control mode, in order to achieve objective value of rolling angle, the left-side auxiliary wings 5 and 6 of the front and rear hydrofoils 3 and 4 are respectively driven at an identical operative angle, whereas the right-side auxiliary wings 5 and 6 of the front and rear hydrofoils 3 and 4 are respectively driven at an identical operative angle in the inverse direction, thus making it possible to properly control rolling angle to result in the minimized motion of the hull 1.

On the other hand, when the neutral control position and the rolling/pitching control position are discretely selected by the stem-height/speed control switch 21 and the rolling/pitching control switch 22, the rolling control mode and the pitching control mode are complexly applied to the auxiliary wings 5/5 of the front hydrofoil 3 and the auxiliary wings 6/6 of the rear hydrofoil 2. According to the rolling control mode, in order to achieve objective value of rolling angle, the left-side auxiliary wings 5 and 6 of the front and rear hydrofoils 3 and 4 are respectively driven at an identical operative angle, whereas the right-side auxiliary wings 5 and 6 of the front and rear hydrofoils 3 and 4 are respectively driven at an identical operative speed in the inverse direction, thus making it possible to properly control rolling angle to result in the minimized motion of the hull 1. According to the pitching control mode, in order to achieve objective value of pitching angle, the auxiliary wings 5/5 on both sides of the front hydrofoil 3 are respectively driven at an identical operative angle, whereas the auxiliary wings 6/6 on both sides of the rear hydrofoil 3 are respectively driven at an identical operative angle in the inverse direction, thus making it possible to properly control pitching angle to result in the minimized motion of the hull 1.

On the other hand, when the control position for stabilizing height of the stem and the rolling/pitching control position are discretely selected by the stem-height/speed control switch 21 and the rolling/pitching control switch 22, the stem-height stabilizing control mode and the rolling/pitching control mode are complexly applied to the auxiliary wings 5/5 on both sides of the front hydrofoil 3, whereas the auxiliary wings 6/6 on both sides of the rear hydrofoil 4 are respectively driven at an identical operative angle in the inverse direction, thus making it possible to properly control pitching angle to result in the minimized motion of the hull 1.

On the other hand, when the control position for stabilizing height of the stem and the rolling/pitching control position are discretely selected by the stem-height/speed control switch 21 and the rolling/pitching control switch 22, the stem-height stabilizing control mode and the rolling/pitching control mode are complexly applied to the auxiliary wings 5/5 on both sides of the front hydrofoil 3, whereas the rolling control mode and the pitching control mode are complexly applied to the auxiliary wings 6/6 on both sides of the rear hydrofoil 2. As a result, the stem-height stabilizing control mode and the pitching control mode are simultaneously activated. According to the stem-height stabilizing control mode, in order to achieve objective value of the height of the stem against water surface, the auxiliary wings 5/5 on both sides of the front hydrofoil 3 are respectively driven at an identical operative angle, thus making it possible to properly stabilize posture of the hull 1 by way of sustaining the height of the stem constant and prevent the front hydrofoil 3 from incurring excessive impact load generated by own skipping behavior According to the rolling control mode, in order to achieve objective value of rolling angle, the left-side auxiliary wings 5 and 6 of the front and rear hydrofoils 3 and 4 are respectively driven at an identical operative angle, whereas the right-side auxiliary wings 5 and 6 of the front and rear hydrofoils 3 and 4 are respectively driven at an identical operative angle in the inverse direction, thus making it possible to properly control rolling angle to result in the minimized motion of the hull 1. According to the pitching control mode, in order to achieve objective value of pitching angle, the auxiliary wings 5/5 on both sides of the front hydrofoil 3 are respectively driven at an identical operative angle, whereas the auxiliary wings 6/6 on both sides of the rear hydrofoil 4 are respectively driven at an identical operative angle in the inverse direction, thus making it possible to properly control pitching angle to result in the minimized motion of the hull 1.

As is explicit from the above description, by virtue of properly controlling height of the stem constant, cruising speed (control operation relates to prevention of the submerged front hydrofoil 3 from coming out of the water surface), rolling and pitching of the hull 1, the twin-hull boat according to the invention can securely cruise itself by way of sustaining the front hydrofoil 3 as of the submerged condition without causing the hull 1 to be wholly lifted up from the water surface. In consequence, the front hydrofoil 3 remains free from being hit by waves, thus saving the front hydrofoil 3 from incurring excessive impact load of waves. By virtue of the above structural and operative arrangements, the twin-hull boat according to the invention can comfortably cruise itself under highly stabilized condition, thus promoting sea-worthiness. In particular, since the twin-hull boat according to the invention securely minimizes own rolling and pitching behaviors, this results in sharply promoted cruising comfort.

Incidentally, any conventional magnetic compass equipped in a conventional ship is susceptible to magnetism generated therein to cause error to easily be generated. To overcome this problem, in place of the conventional magnetic compass, the twin-hull boat embodied by the invention is equipped with a global positioning system 12 for precisely identifying the actual position of the hull itself, thus fully eliminating erroneous identification of the bearing caused by magnetism. Furthermore, the control system of the inventive twin-hull boat can securely correct angles of rolling and pitching and speed of the variation of rolling detected by the first and second inertia sensors 13A and 13B. In consequence, the novel control system provided for the inventive twin-hull boat can more precisely control rolling/pitching behaviors of the hull 1 by way of minimizing the rolling/pitching effect, thus resulting in the sharply improved cruising comfort. Any material that may be affected by magnetism may also be introduced.

Furthermore, since the twin-hull boat according to the invention is equipped with fully submergible front and rear hydrofoils 3 and 4, these hydrofoils 3 and 4 are free from being hit by waves. In addition. since the hull 1 consists of a twin-hull structure, the hull 1 can constantly cruise itself under extremely stabilized condition.

What is claimed is:

1. A twin-hull boat equipped with a front hydrofoil (3) and a rear hydrofoil (4) below the bottom of a hull (1) comprising:

a pair of right and left auxiliary wings (5) respectively secured to the right and left ends of the front hydrofoil (3) and driven independently;

a pair of right and left auxiliary wings (6) respectively secured to the right and left ends of the rear hydrofoil (4) and driven independently;

a height sensor (11) secured to the stem of the hull (1) in order to measure height from the stem to the water surface;

an inertia sensor or a gyroscope (13A) disposed at the center of motion of the hull (1) in order to detect a rolling angle of the hull (1);

a bearing measuring unit (12) for measuring actual bearing of the hull, and a computing unit (15) for calculating actual speed and bearing of the hull (1) on the basis of hull bearing data detected by the bearing measuring unit (12), both being mounted on the hull (1); and a controller unit (14) disposed on the hull (1) for (a) correcting a rolling angle detected by the inertia sensor or gyroscope (13A) on the basis of speed and bearing data of the hull (1) calculated by the computing unit (15), (b) driving the pairs of auxiliary wings (5)(6), each right and left wings being in opposed directions to each other, in order that the corrected rolling angle becomes smaller than a desired rolling angle, and (c) driving the right and left auxiliary wings (5) of the front hydrofoil (3), both at the same angle, in order that a stem height measured by the height sensor (11) becomes identical to a desired stem height.

2. A twin-hull boat equipped with a front hydrofoil (3) and a rear hydrofoil (4) below the bottom of a hull (1) comprising:

a pair of right and left auxiliary wings (5) respectively being secured to the right and left ends of the front hydrofoil (3) and driven independently;

a pair of right and left auxiliary wings (6) respectively being secured to the right and left ends of the rear hydrofoil (4) and driven independently;

a pair of inertia sensors or gyroscopes (13A)(13B) disposed at the center of motion of the hull (1) in order to detect a rolling angle and a pitching angle of the hull (1);

a bearing measuring unit (12) for measuring actual bearing of the hull, and a computing unit (15) for calculating actual speed and bearing of the hull (1) on the basis of hull bearing data detected by the bearing measuring unit (12) both being disposed on the hull (1); and a controller unit (14) disposed on the hull (1) for (a) correcting a rolling angle and a pitching angle detected by the inertia sensors or gyroscopes (13A)(13B) on the basis of speed and bearing data of the hull (1) calculated by the computing unit (15), (b) driving the right and left auxiliary wings (5)(6), each right and left wings being in opposed directions to each other, in order that the corrected rolling angle becomes smaller than a desired rolling angle, and (c) driving the right and left auxiliary wings (5) of the front hydrofoil (3), both at the small angle, and driving the right and left wings (6) of the rear hydrofoil (4), both at the same angle but in opposed directions to the corresponding wings (5) of the front hydrofoil (3), in order that the corrected pitching angle becomes smaller than a desired pitching angle.

3. A twin-hull boat equipped with a front-hydrofoil (3) and a rear hydrofoil (4) below the bottom of a hull (1) comprising:

a pair of right and left auxiliary wings (5) respectively being secured to the right and left ends of the front hydrofoil (3) and driven independently;

a pair of right and left auxiliary wings (6) respectively being secured to the right and left ends of the rear hydrofoil (4) and driven independently;

a height sensor (11) secured to the stem of the hull (1) in order to measure height from the stem to the water surface;

a pair of inertia sensors or gyroscopes (12A)(13B) disposed at the center of motion of the hull (1) in order to detect a rolling angle and a pitching angle of the hull (1);

a bearing measuring unit (12) for measuring actual bearing of the hull (1), and a computing unit (15) for calculating actual speed and bearing of the hull (1) on the basis of hull bearing data detected by the bearing measuring unit (12), both being disposed on the hull (1); and a controller unit (14) disposed on the hull (1) for (a) correcting a rolling angle and a pitching angle detected by the inertia sensors or gyroscopes (13A)(13B) on the basis of speed and bearing data of the hull (1) calculated by the computing unit (15), (b) driving the right and left auxiliary wings (5)(6), each right and left wings being in opposed directions to each other, in order that the corrected rolling angle becomes smaller than a desired rolling angle, (c) driving the right and left auxiliary wings (5) of the front hydrofoil (3), both at the same angle, and driving the right and left wings (6) of the rear hydrofoil (4), both at the same angle but in opposed directions to the corresponding wings (5) of the front hydrofoil (3), in order that the corrected pitching angle becomes smaller than a desired pitching angle, and (d) driving the right and left auxiliary wings (5) of the front hydrofoil (3), both at the same angle, in order that the corrected stem height detected by the height sensor (11) becomes identical to a desired stem height.

4. A twin-hull boat equipped with a front hydrofoil (3) and a rear hydrofoil (4) below the bottom of a hull (1) comprising:

a pair of right and left auxiliary wings (5) respectively being secured to the right and left ends of the front hydrofoil (3) and driven independently;

a pair of right and left auxiliary wings (6) respectively being secured to the right and left ends of the rear hydrofoil (4) and driven independently;

a bearing measuring unit (12) for measuring actual bearing of the hull, and a computing unit (15) for calculating actual speed and bearing of the hull (1) on the basis of hull bearing data detected by the bearing measuring unit (12), both being disposed on the hull (1); and an inertial sensor or a gyroscope (13A) disposed at the center of motion of the hull (1) in order to detect a rolling angle and a pitching angle of the hull (1);

a controller unit (14) disposed on the hull (1) for (a) correcting a rolling angle detected by the inertia sensor or gyroscope (13A) on the basis of speed and bearing data of the hull (1) calculated by the computing unit (15), (b) driving the pairs of auxiliary wings (5)(6), each right and left wings being in opposed directions to each other, in order that the corrected rolling angle become smaller than a desired rolling angle, and (c) driving the right and left auxiliary wings (5) of the front hydrofoil (3), both at the same angle, on the basis of the cruising speed of the hull detected by the computing unit (15) in order that the right and left wings (5) of the front hydrofoil (3) can be prevented from protruding above the water surface.

5. A twin-hull boat as set forth in claim 1 or claim 2 or claim 3 or claim 4, wherein the bearing measuring unit (12) consists of a wide-area bearing measuring unit.

* * * * *